US006064413A

United States Patent [19]

Fukui et al.

[11] Patent Number: 6,064,413

[45] Date of Patent: May 16, 2000

[54] PRINTED DATA ERASING METHOD FOR REWRITABLE CARD AND APPARATUS FOR CARRYING OUT THE SAME

[75] Inventors: Takeshi Fukui; Hideaki Arakida; Yoshihiro Nabeshima, all of Matsusaka, Japan

[73] Assignees: F Engineering Co., Ltd., Mei-ken; Tokyo Magnetic Printing Co. Ltd., Tokyo, both of Japan

[21] Appl. No.: 09/316,679

[22] Filed: May 21, 1999

[30] Foreign Application Priority Data

Sep. 22, 1998 [JP] Japan ..... 10-267910

[51] Int. Cl.[7] ..... B41J 2/32

[52] U.S. Cl. ..... 347/171

[58] Field of Search ..... 347/171; 400/120.01

[56] References Cited

U.S. PATENT DOCUMENTS 5,852,463 12/1998 Koshida et al. ..... 347/171

5,946,019 8/1999 Suzuki et al. ..... 347/171

*Primary Examiner*—Huan Tran

*Attorney, Agent, or Firm*—Seidel, Gonda, Lavorgna & Monaco, PC

[57] ABSTRACT

In a rewritable card read/write apparatus including a printing thermal head (11) for printing data thermally and a transporting mechanism for feeding a rewritable card (19) forwardly and backwardly so that the rewritable card (19) can pass by the thermal head (11), a method which allows the printed data to be erased within a short time with the thermal head (11) itself. A columnwise printed data erasing range (18) of a printed data area is designated for the card (19) inserted into the apparatus. The thermal head (11) is electrically energized successively at least in two serial cycles by changing over electric energy level at least from a first electric energy level in a first cycle to a second electric energy level in a second cycle. The first electric energy level is so set that a columnwise range of the thermal head (11) which corresponds to the printed data erasing range (18) of the card (19) is heated to a relatively high temperature within a temperature range in which no coloration can occur in the printed data area when the rewritable card (19) reaches a position immediately beneath the thermal head (11). The second electric energy level is set lower than the relatively high temperature and validated when the card (19) again reaches the position immediately beneath the thermal head (11) in the second cycle. The transporting mechanism is controlled such that the rewritable card (19) is fed in a forward direction or in a reverse direction so that the rewritable card (19) moves immediately beneath the thermal head (11) from a first rowwise position corresponding to one end of the printed data erasing range (18) to a second rowwise position corresponding to the other end of the printed data erasing range (18) or alternatively from the second rowwise position to the first rowwise position.

3 Claims, 4 Drawing Sheets

12
CONTROL UNIT
9
DRIVE MOTOR
14
PHOTO-SENSOR
11
THERMAL HEAD
10
MAGNETIC HEAD
13
MOTOR DRIVING CIRCUIT
15
SENSOR SIGNAL INPUT CIRCUIT
16
THERMAL HEAD DRIVE CIRCUIT
17
MAGNETIC READ/WRITE CIRCUIT
21
CPU
22
ROM
23
RAM

ELECTRICAL ENERGIZATION OF THERMAL HEAD IN THREE CYCLES

PRINTED DATA ERASING METHOD FOR REWRITABLE CARD AND APPARATUS FOR CARRYING OUT THE SAME

BACKGROUND OF THE INVENTION

1. Field of the Invention

The present invention relates to a method of erasing thermally printed data of a rewritable card and an apparatus for carrying out the same. More particularly, the present invention is concerned with improvement of the printed data erasing method for the rewritable card and the apparatus therefor in which one and the same thermal head is employed for thermally printing and erasing data.

2. Description of Related Art

Printed symbols such as, for example, characters, signs, images, graphics and/or the like (hereinafter referred to as the printed data) recorded on a rewritable card with the aid of a thermal head can be erased by heating the area where the printed data are resident up to a temperature which is lower than the temperature level at which the thermal printing has been performed. For example, a card comprised of a recording layer containing a leuco base or dye supported on a support is known as having such characteristics. As the heating means dedicated to the erasure of the printed data, there have heretofore been employed a heat applying plate, a heating roller, a thermal bar or the like. However, from the standpoint of decreasing the manufacturing cost of the rewritable card read/write apparatus and realizing the same in a miniature structure, approaches have been made for developing methods of erasing the thermally printed data of the rewritable card by using the very thermal head itself in place of the erasure dedicated device such as those mentioned above. As one of the methods, there can be mentioned a method according to which the thermal head is electrically energized in an erasure-dedicated step provided additionally and separately from the printing step. Other printed data erasing method for the rewritable card is what is referred to as the overwrite method according to which the data erasing operation and the data printing operation are carried out in one and the same cycle or stroke.

In this conjunction, it is however noted that the thermal head is intrinsically so designed as to heat locally a region of smaller area when compared with the area heated by the heating means dedicated to the erasure of the printed data. Consequently, when a rewritable card is so fed that a printed erasing range thereof is caused to move underneath the thermal head only once at a speed substantially corresponding to an ordinary card feeding speed as in the case of the typical apparatuses known heretofore, difficulty is encountered in allowing the heated card portion to be cooled gradually or slowly (i.e., at a low rate) so that discoloration of the data dot area can occur sufficiently. Besides, the discoloration characteristic of the rewritable card may undergo the influence of the ambient temperature. For these reasons, there exists a problem that some data fragments are likely to remain as the residue even after the data erasing process. Same holds true for the overwrite-type printed data erasing method.

In order to evade such poor effectiveness of the gradual or slow cooling of the rewritable card after passing by the thermal head or to prevent speedy cooling (i.e., cooling at a high rate) of the rewritable card, it is conceivable to control the feeding speed of the rewritable card such that the printed data erasing range or region of the rewritable card can move beneath the thermal head at a relatively low speed. In that case, however, the time taken for executing all the requisite processings on the card or the time taken until the card inserted into the apparatus by a user or customer is discharged therefrom, to say in another way, will become extremely long, giving rise to another problem. By way of example, the time taken for executing all the requisite processings will usually range from seven to ten seconds when the erasure-dedicated heating means is employed. By contrast, in the case of the single-cycle printed data erasing method or the overwrite-type printed data erasing method in which the thermal head is employed for both the printing of data and the erasure thereof, the processing time will amount to as long as ten to fifteen seconds.

SUMMARY OF THE INVENTION

In the light of the state of the art described above, it is an object of the present invention to provide a printed data erasing method for a rewritable card read/write apparatus of a thermal head erasure type such as mentioned above, which method allows thermally printed data on a rewritable card to be thermally erased without being accompanied with residues of data fragments and without lengthening the processing time.

Another object of the present invention is to provide a rewritable card read/write apparatus arranged so as to be capable of carrying out the method mentioned above.

In view of the above and other objects which will become apparent as the description proceeds, the present invention is directed to a rewritable card read/write apparatus which includes a magnetically recordable data write/read magnetic head adapted for writing magnetically data and reading the magnetically written or recorded data, a printing thermal head adapted for printing data thermally, and a transporting mechanism adapted for feeding a rewritable card inserted into the rewritable card read/write apparatus through a card inlet port forwardly and backwardly so that the rewritable card passes by the magnetic head and the thermal head sequentially or serially.

In conjunction with the rewritable card read/write apparatus mentioned above, there is provided according to a general aspect of the present invention a printed data erasing method for the rewritable card, which method includes the steps mentioned below. Namely, a) a step of designating a printed data erasing range in a printed data region or area of the rewritable card inserted into the rewritable card read/write apparatus, b) a step of energizing electrically the thermal head at least in two sequential or serial cycles (or strokes) by changing over electric energy level for the electric energization at least from a first electric energy level in a first cycle to a second electric energy level in a second cycle, wherein the first electric energy level is so set that a columnwise range of the thermal head which corresponds to the printed data erasing range of the rewritable card is heated in the first cycle to a relatively high temperature within a temperature range in which no coloration can occur in the printed data area of the rewritable card when the rewritable card reaches the position immediately beneath the thermal head, and wherein the second electric energy level which is set lower than the relatively high temperature is validated when the rewritable card again reaches the position immediately beneath the thermal head in the second cycle succeeding to said first cycle, and c) a step of controlling driving operation of the transporting mechanism in the step of electrically energizing the thermal head with the first or second electric energy level in such a manner that the rewritable card is fed in a forward direction or in a reverse direction so that the rewritable card moves immediately beneath the thermal head from a first rowwise position corresponding to one end of the printed data erasing range of the rewritable card to a second rowwise position corresponding to the other end of the printed data erasing range or alternatively from the second rowwise position to the first rowwise position.

With the arrangement of the printed data erasing method, the electrical energization of the thermal head is so changed over that the portion or range of the rewritable card from which the printed data are to be erased is heated in the first cycle up to a high temperature level which is slightly lower than the temperature level at which coloration can occur and then heated to the second temperature level which is lower than the above mentioned high temperature level in the second cycle succeeding to the first cycle, wherein the rewritable card is so driven that the printed data erasing range moves immediately beneath the thermal head from one to the other end thereof or vice versa in each cycle. By virtue of such arrangement, the temperature of the printed data erasing region or range can change in following a preferred gradual cooling curve after the first heating cycle. Furthermore, because the thermal head is supplied with high electric energy for the printed data erasure to be thereby heated latently to the temperature higher than the ambient temperature, the influence thereof exerted to the card can be effectively suppressed.

In a preferred mode for carrying out the method mentioned above, the step of electrically energizing the thermal head may be effectuated sequentially in three successive cycles with three different electric energy levels lowering successively, wherein upon every electrical energization with the different electric energy levels, respectively, the rewritable card is driven in a forward or backward feeding direction over a distance corresponding to that intervening between both ends of the printed data erasing range.

With the arrangement described above, a gradual cooling of the printed data erasing range can be realized in accordance with a preferred gradual cooling curve. It should however be mentioned that the number of energizing or heating cycles may be determined or selected appropriately in dependence on the discoloration characteristics of the actual rewritable card.

According to another aspect of the present invention, there is provided a rewritable card read/write apparatus, which includes a magnetically recordable data write/read magnetic head for writing magnetically data and reading magnetically written data, a printing thermal head for printing data thermally, a transporting mechanism for feeding a rewritable card inserted into the rewritable card read/write apparatus through a card inlet port forwardly and backwardly so that the rewritable card can pass by the magnetic head and the thermal head serially, a printed data erasing range designating means for designating a printed data erasing range in a printed data area of the rewritable card inserted into the rewritable card read/write apparatus, an electrically energizing means for energizing electrically the thermal head successively at least in two serial cycles by changing over electric energy level for the electric energization successively at least from a first electric energy level in a first cycle to a second electric energy level in a second cycle, wherein the first electric energy level is so set that a columnwise range of the thermal head which corresponds to the printed data erasing range of the rewritable card is heated in the first cycle to a relatively high temperature within a temperature range in which no coloration can occur in the printed data area of the rewritable card when the rewritable card reaches a position immediately beneath the thermal head, and wherein the second electric energy level which is set lower than the relatively high temperature is validated when the rewritable card again reaches the position immediately beneath the thermal head in the second cycle succeeding to the first cycle, and a control means for controlling operation of the transporting mechanism upon electrical energization of the thermal head with the first or second level of electric energy in such a manner that the rewritable card is fed in a forward or reverse direction so that the rewritable card moves immediately beneath the thermal head from a first rowwise position corresponding to one end of the printed data erasing range of the rewritable card to a second rowwise position corresponding to the other end of the printed data erasing range or alternatively from the second rowwise position to the first rowwise position.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DESCRIPTION OF THE PREFERRED EMBODIMENTS

Figure 1:
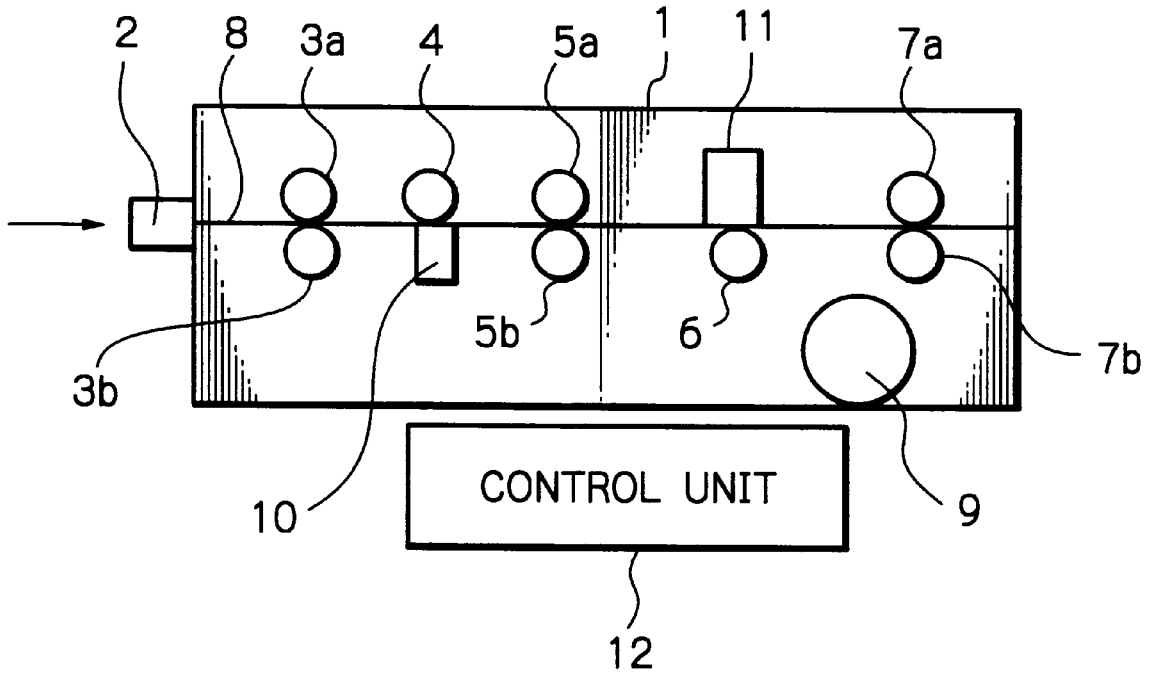
FIG. 1 is a schematic block diagram showing a basic structure of a rewritable card read/write apparatus to which the method according to the present invention is to be applied.

The present invention will be described in detail in conjunction with what is presently considered as preferred or typical embodiments thereof by reference to the drawings. In the following description, like reference characters designate like or corresponding parts throughout the several views. Also in the following description, it is to be understood that such terms as "left", "right", "forward", "backward", "reverse", "column", "columnwise", "row", "rowwise" and the like are words of convenience and are not to be construed as limiting terms.

FIG. 1 is a schematic block diagram showing a basic structure of a rewritable card read/write apparatus to which the thermally printed data erasing method according to the present invention is to be applied. Referring to the figure, reference numeral 1 denotes generally a main body of the rewritable card read/write apparatus which is comprised of a card inlet port 2, card transporting rollers 3*a* and 3*b*, a presser roller 4, transporting rollers 5*a* and 5*b*, a presser roller 6 and transporting rollers 7*a* and 7*b* disposed in this order, as viewed from the left-hand side in FIG. 1. In the apparatus, an inserted rewritable card can be fed or displaced along a transporting path 8. For driving the transporting rollers mentioned above through the medium of a suitable transmission mechanism (not shown), an electric drive motor 9 is provided which may be constituted by a stepping motor, as will be described hereinafter. A magnetic head 10 designed for reading/writing data magnetically is disposed beneath the presser roller 4 across the transporting path 8 in opposition to the presser roller 4. On the other hand, a thermal head 11 designed for performing data rewriting and erasing operation on the rewritable card is disposed above the presser roller 6 across the transporting path 8 in opposition to the presser roller 6.

A control unit 12 shown schematically in FIG. 1 as disposed below the rewritable card read/write apparatus in FIG. 1 incorporates therein a control circuit for updating a rewritable card inserted into the rewritable card read/write apparatus 1 by controlling the roller drive motor 9, the magnetic head 10 and the thermal head 11. The arrangement described so far is known heretofore.

Figure 2:
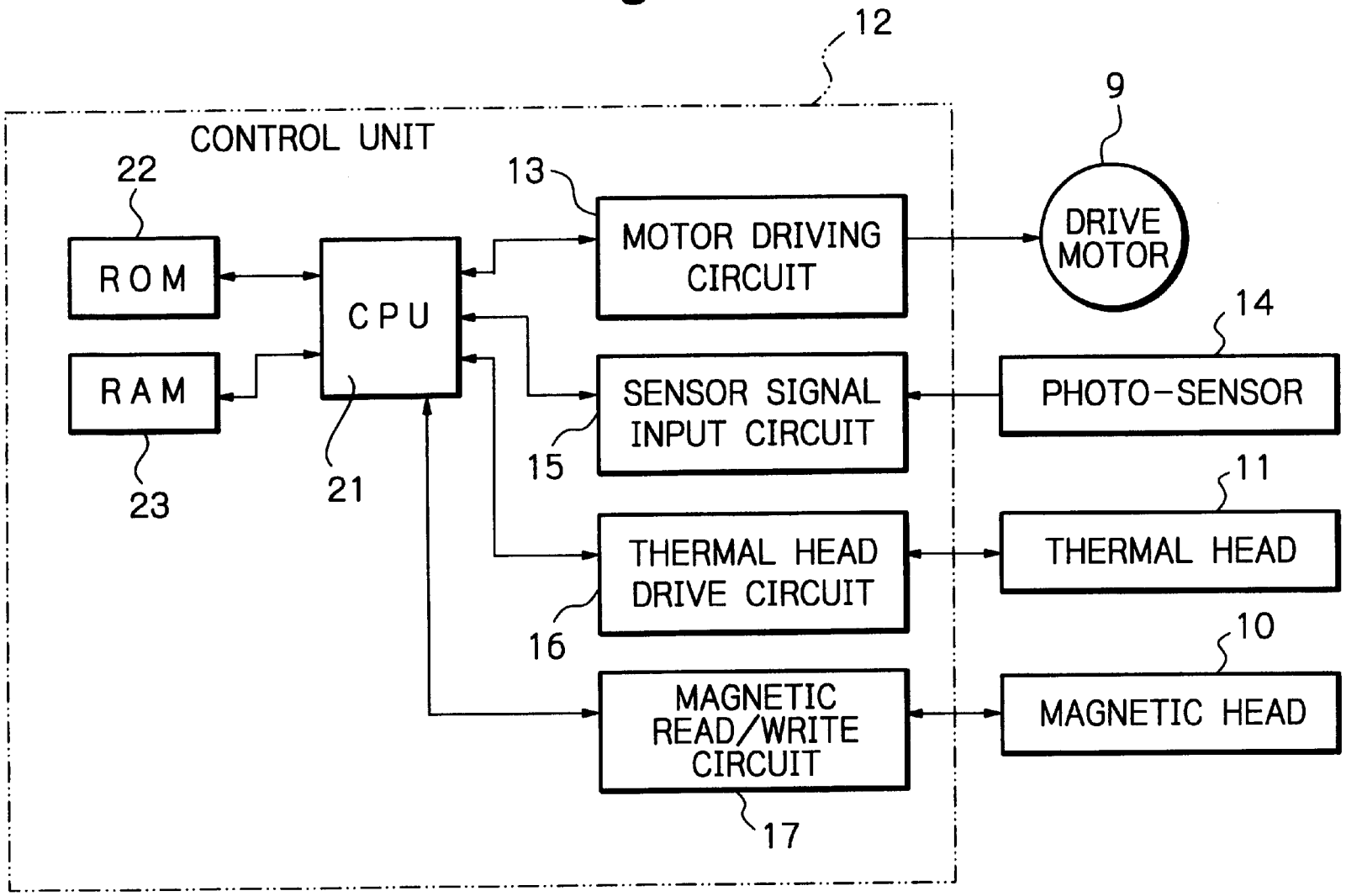
FIG. 2 is a block diagram showing a circuit arrangement implemented in a control unit which is designed to control operations of the rewritable card read/write apparatus shown in FIG. 1.

FIG. 2 is a block diagram showing a circuit arrangement implemented in the control unit 12. As can be seen in the figure, there are incorporated in the control unit 12 a CPU (central processing unit) 21 for controlling read/write operations as well as update operations and other processings to be performed on the rewritable card, a ROM (read-only memory) 22 for storing program and font data for printing, and a RAM (random access memory) 23 serving for work register function and at the same time storing a variety of data. Interconnected to the CPU 21 are a motor driving circuit 13 for generating exciting current pulses for driving the drive motor 9 which is constituted by a stepping motor for feeding the rewritable card along the transporting path 8, a sensor signal input circuit 15 for receiving the output of a photo-sensor 14 which is employed for performing the positioning of the rewritable card and the like, a thermal head drive circuit 16 for outputting data and erasing pulse signal and receiving data derived from a thermistor (not shown) provided in association with the thermal head 11 for measuring the temperature of the thermal head 11 and a magnetic read/write circuit 17 for performing modulation and demodulation processings on the input and output signals, respectively, of the magnetic head 10.

Parenthetically, the control unit described above may be constituted by a microprocessor or microcomputer equipped with peripheral circuits such as the motor drive circuit 13, the sensor signal input circuit 15 and so forth and implemented in the form of an integrated circuit or IC.

Figure 3A:
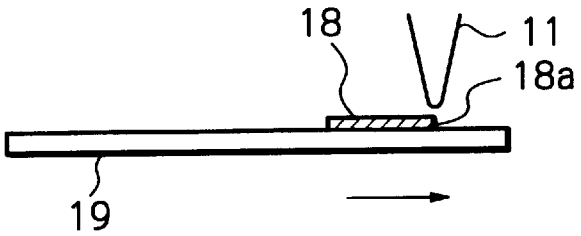
FIG. 3A is a schematic view for illustrating a position of a rewritable card upon start of a first cycle for erasing data printed thermally in a printed data area of a rewritable card in a rewritable card read/write apparatus shown in FIG. 1.
Figure 3B:
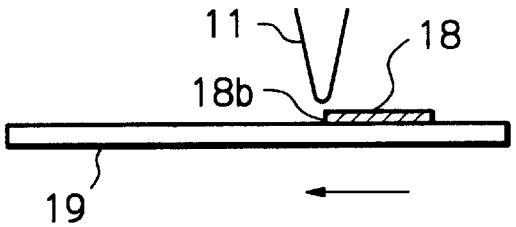
FIG. 3B is a schematic view similar to FIG. 3A for illustrating a position of a rewritable card upon start of a succeeding or second cycle for erasing data printed thermally in the printed data area of the rewritable card in the rewritable card read/write apparatus shown in FIG. 1.

FIGS. 3A and 3B are schematic views for illustrating operation for erasing the data printed in a printed data area of the rewritable card inserted into the read/write main unit 1 shown in FIG. 1. In these figures, reference numeral 18 designates a printed data erasing range of a rewritable card 19. In the case of the instant embodiment of the invention, it is assumed that the whole rewritable area is designated as the range to undergo currently the erasing operation. Parenthetically, the range or field which is to undergo the printed data erasing operation is referred to as the printed data erasing range. In this conjunction, it should however be mentioned that the printed data erasing range can be designated arbitrarily or selectively in the rowwise and/or columnwise direction on a card-by-card basis in each erasing operation cycle in dependence on the type of the card and the erasing operation cycles mentioned below. In the state shown in FIG. 3A, it is assumed that the rewritable card 19 is inserted into the rewritable card read/write apparatus from the left-hand side thereof, as viewed in the figures and transported to an erasure-ready position after having undergone proper processings. In this state, a leading row 18*a* of the printed data erasing range 18 of the rewritable card 19 is positioned immediately beneath the thermal head 11. When the rewritable card 19 is set to the position shown in FIG. 3A, the thermal head 11 is electrically energized so that the printed data erasing range 18 is heated to a first temperature level which is slightly lower than a temperature level at which coloration occurs. Hereinafter, this temperature will be referred to as the coloration temperature level. Further, the heating to the first temperature level will be referred to the first cycle. The rewritable card 19 is fed continuously toward the right-hand side of the rewritable card read/write apparatus 1 while being heated by the thermal head 11. The first cycle (forward feeding stroke) is completed when the rewritable card 19 reaches the position shown in FIG. 3B where the trailing row 18*b* of the printed data erasing range 18 is positioned immediately beneath the thermal head 11. The rewritable card 19 undergone the first heating cycle is then fed reversely or backwardly. More specifically, when the rewritable card 19 has reached the state illustrated in FIG. 3B in which the trailing row 18*b* of the printed data erasing range 18 of the rewritable card 19 is positioned immediately beneath the thermal head 11, the thermal head 11 is electrically energized so that the printed data erasing range 18 of the card is heated to a second temperature level which is slightly lower than the first temperature in the first cycle (i.e., during the forward stroke). This process is referred to as the second cycle. Thereafter, the rewritable card 19 is fed continuously toward the left-hand side of the rewritable card read/write apparatus, being heated to the second temperature level. The second cycle (backward or reverse feeding stroke) is completed when the trailing row 18*b* of the printed data erasing range 18 reaches the position immediately beneath the thermal head 11, as shown in FIG. 3A. In the case of the illustrative embodiment of the invention, it is assumed that the rewritable card 19 is to undergo three cycles of erasing operation at different temperature levels. Accordingly, starting from the state where the leading row 18*a* of the printed data erasing range 18 is positioned immediately beneath the thermal head 11, the rewritable card is again fed forwardly toward the right-hand side of the rewritable card read/write apparatus. This process is referred to as the third cycle. In the third cycle, heating of the thermal head 11 is so controlled that the temperature of the rewritable card 19 becomes lower than the temperature level in the second cycle. Upon completion of the third cycle, the rewritable card 19 is fed backwardly and assumes the position illustrated in FIG. 3B. At this time point, data recorded in the printed data erasing range 18 of the rewritable card 19 has been erased completely.

Figure 4:
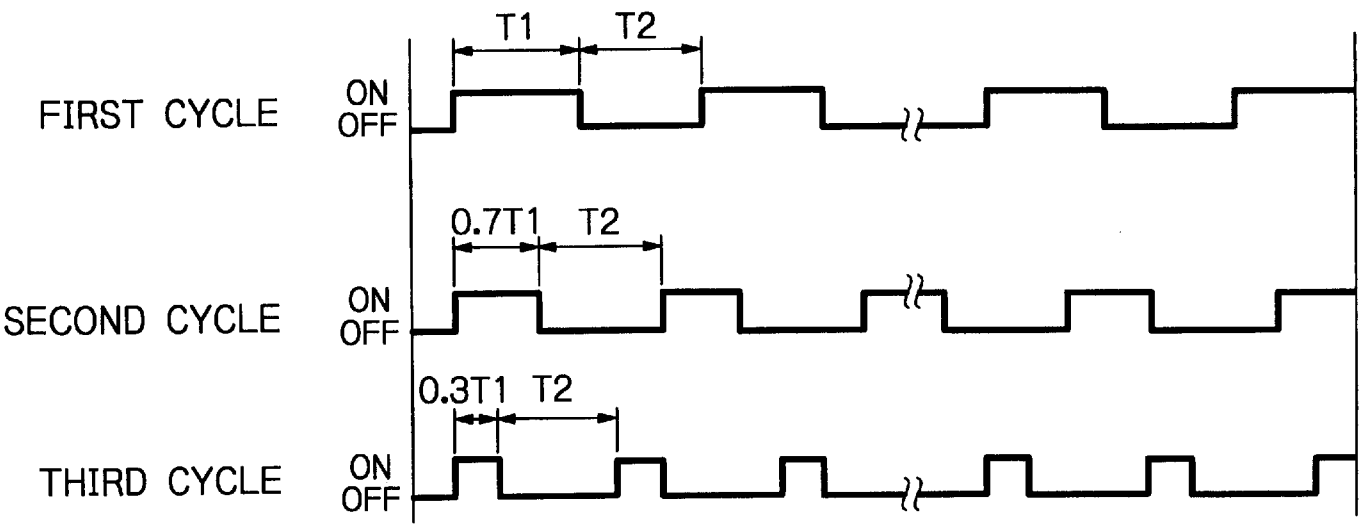
FIG. 4 is a waveform diagram for illustrating, by way of example, changes of electric energy supplied to a thermal head in first to third cycles for erasing thermally printed data in first to third cycles or strokes.

FIG. 4 is a chart for illustrating changes of electric energy supplied to the thermal head for erasing the recorded data in the first to third cycles described above. In the first cycle, the electric energy supplied to the thermal head 11 in the form of constant-amplitude pulses each having an initial reference pulse width T1 and an initial reference off time T2. As can be seen in FIG. 4, the duty ratio or cycle of the electric energy supplied to the thermal head 11 in the first cycle (forward feeding stroke) is given by $T1/(T1+T2)$.

In the second cycle (reverse feeding stroke), the duty cycle of the electric energy supplied to the thermal head 11 is given by $0.7T1/(0.7T1+T2)$.

Finally, in the third cycle (forward feeding stroke), the electric energy supplied to the thermal head 11 is given by $0.3T1(0.3T1+T2)$.

Parenthetically, during a single-dot period of 1 to 2 ms, several tens to several hundreds of pulses mentioned are applied to the thermal head 11. Further, the ratio between the temporal durations T1 and T2 may be selected such that T1>T2, T1 T2 or T1<T2 in dependence on the ambient temperature.

Figure 5:
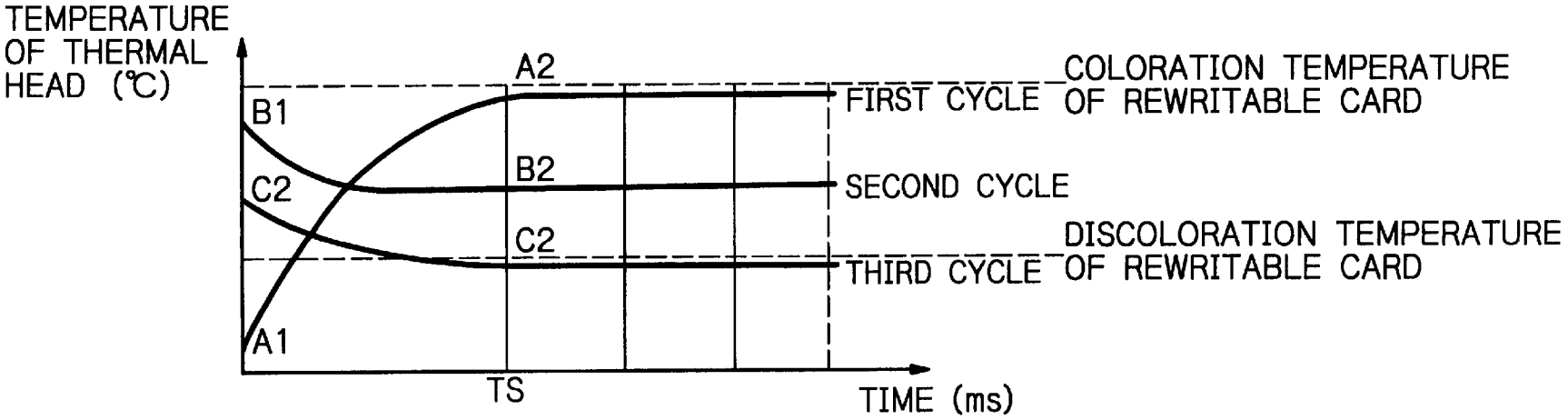
FIG. 5 is a view for illustrating graphically in what manner the temperature of an erasure designated range of the rewritable card changes in every cycles or strokes with the energizations of the thermal head as illustrated in FIG. 4.

FIG. 5 is a view for illustrating graphically changes or transitions of the temperature in the erasure designated range of the rewritable card in the thermal head energizing cycles described above. In the case of the example illustrated in FIG. 5, it is presumed that the erasure designated range of the rewritable card 19 is heated to the temperature level only slightly lower than the coloration temperature level in the first cycle (forward feeding stroke). In the second cycle (reverse feeding stroke), the temperature of the erasure designated range 18 is lowered by 30% from the temperature level in the first cycle. Finally, in the third cycle (forward feeding stroke), the temperature level concerned is lowered by ca. 60% relative to the temperature level in the first cycle. Incidentally, the reference symbols inserted in FIG. 5 indicate, respectively, contents mentioned below.

Ts: time point at which the erasing operation is started,

A1: temperature level upon starting of the first cycle (ambient temperature),

A2: saturation temperature level in the first cycle (forward feeding stroke) which is slightly lower than the coloration temperature level of the rewritable card, B1: temperature level upon starting of the second cycle (reverse feeding stroke) which corresponds to the saturation temperature level in the first cycle), B2: saturation temperature level in the second cycle (temperature level between the coloration level and the discoloration level of the rewritable card), C1: temperature level upon starting of the third cycle (forward feeding stroke) which corresponds to the saturation temperature level in the second cycle, and C2: saturation temperature level in the third cycle (discoloration or color-extinction temperature level of the rewritable card).

In the rewritable card read/write apparatus according to the illustrated embodiment of the present invention, the three feeding strokes of the rewritable card relative to the thermal head can be completed within one second with the data carried by rewritable card being erased completely. Furthermore, the overall processing time intervening between the insertion of the rewritable card into the apparatus and discharge therefrom can be shortened to ca. 3 seconds or so.

As is apparent from the foregoing, there has been provided according to the present invention a method capable of erasing the printed data recorded on the rewritable card by the thermal head within an extremely short time. Thus, the present invention makes a great contribution to the reduction of the manufacturing and operation costs of the rewritable card read/write apparatus as well as reduction of the time involved in the processing of the rewritable card.

Many features and advantages of the present invention are apparent from the detailed description and thus it is intended by the appended claims to cover all such features and advantages of the system which fall within the true spirit and scope of the invention. Further, since numerous modifications and combinations will readily occur to those skilled in the art, it is not intended to limit the invention to the exact construction and operation illustrated and described. Accordingly, all suitable modifications and equivalents may be resorted to, falling within the spirit and scope of the invention.

What is claimed is:

1. In a rewritable card read/write apparatus including a magnetically recordable data write/read magnetic head for writing magnetically data and reading magnetically written data, a printing thermal head for print ing data thermally, and a transporting mechanism for feeding a rewritable card inserted into said rewritable card read/write apparatus through a card in let port forwardly and backwardly so that said rewritable card can pass by said magnetic head and said thermal head serially, a printed data erasing method for said rewritable card, comprising the steps of:

a) designating a printed data erasing range in a printed data area of said rewritable card inserted into said rewritable card read/write apparatus;

b) energizing electrically said thermal head successively at least in two serial cycles by changing over electric energy level for said electric energization at least from a first electric energy level in a first cycle to a second electric energy level in a second cycle, wherein said first electric energy level is so set that a columnwise range of said thermal head which corresponds to said printed data erasing range of said rewritable card is heated in said first cycle to a relatively high temperature within a temperature range in which no coloration can occur in the printed data area of said rewritable card when said rewritable card reaches a position immediately beneath said thermal head, and wherein said second electric energy level which is set lower than said relatively high temperature is validated when said rewritable card again reaches said position immediately beneath said thermal head in said second cycle succeeding to said first cycle; and c) controlling driving operation of said transporting mechanism in said step of electrically energizing said thermal head with said first or second level of electric energy in such a manner that said rewritable card is fed in a forward direction or in a reverse direction so that said rewritable card moves immediately beneath said thermal head from a first rowwise position corresponding to one end of said printed data erasing range of said rewritable card to a second rowwise position corresponding to the other end of said printed data erasing range or alternatively from said second rowwise position to said first rowwise position.

2. A printed data erasing method for a rewritable card according to claim 1, said step of electrically energizing said thermal head being effectuated sequentially in three successive cycles with three different electric energy levels lowering successively, wherein upon every electrical energization with said different electric energy levels, respectively, said rewritable card is driven in a forward or backward feeding direction over a distance corresponding to that intervening between both ends of said printed data erasing range.

3. A rewritable card read/write apparatus, comprising:

a magnetically recordable data write/read magnetic head for writing magnetically data and reading magnetically written data;

a printing thermal head for printing data thermally;

a transport ing mechanism for feeding a rewritable card inserted into said rewritable card read/write apparatus through a card inlet port forwardly and backwardly so that said rewritable card can pass by said magnetic head and said thermal head serially;

printed data erasing range designating means for designating a printed data erasing range in a printed data area of said rewritable card inserted into said rewritable card read/write apparatus;

electrically energizing means for energizing electrically said thermal head successively at least in two serial cycles by changing over electric energy level for said electric energization successively at least from a first electric energy level in a first cycle to a second electric energy level in a second cycle, wherein said first electric energy level is so set that a columnwise range of said thermal head which corresponds to said printed data erasing range of said rewritable card is heated in said first cycle to a relatively high temperature within a temperature range in which no coloration can occur in the printed data area of said rewritable card when said rewritable card reaches a position immediately beneath said thermal head, and wherein said second electric energy level which is set lower than said relatively high temperature is validated when said rewritable card again reaches said position immediately beneath said thermal head in said second cycle succeeding to said first cycle; and control means for controlling operation of said transporting mechanism upon electrical energization of said thermal head with said first or second level of electric energy in such a manner that said rewritable card is fed in a forward or reverse direction so that said rewritable card moves immediately beneath said thermal head from a first rowwise position corresponding to one end of said printed data erasing range of said rewritable card to a second rowwise position corresponding to the other end of said printed data erasing range or alternatively from said second rowwise position to said first rowwise position.

* * * * *